US012111129B2

(12) United States Patent
Curry

(10) Patent No.: US 12,111,129 B2
(45) Date of Patent: Oct. 8, 2024

(54) COMBINATION GRIP SPACER AND CATCH PLATE

(71) Applicant: Smith & Wesson Inc., Springfield, MA (US)

(72) Inventor: Brett Curry, Monson, MA (US)

(73) Assignee: SMITH & WESSON INC., Springfield, MA (US)

( * ) Notice: Subject to any disclaimer, the term of this patent is extended or adjusted under 35 U.S.C. 154(b) by 0 days.

(21) Appl. No.: 17/893,426

(22) Filed: Aug. 23, 2022

(65) Prior Publication Data

US 2023/0266083 A1 Aug. 24, 2023

Related U.S. Application Data

(60) Provisional application No. 63/312,908, filed on Feb. 23, 2022.

(51) Int. Cl.
*F41A 9/65* (2006.01)

(52) U.S. Cl.
CPC ..... *F41A 9/65* (2013.01)

(58) Field of Classification Search
CPC ..... F41A 9/61; F41A 9/64; F41A 9/65
See application file for complete search history.

(56) References Cited

U.S. PATENT DOCUMENTS 3,377,732 A * 4/1968 Bivens ..... F41A 9/85 42/50
4,592,160 A * 6/1986 Bross ..... F41A 9/65 42/7
5,081,778 A * 1/1992 Switzer ..... F41A 9/66 42/50
5,438,783 A * 8/1995 Sniezak ..... F41A 9/65 42/50
7,093,386 B1 * 8/2006 Vieweg ..... F41A 9/65 42/7
7,117,622 B2 * 10/2006 Freed ..... F41A 9/65 42/71.02
7,200,963 B1 4/2007 Vieweg
7,908,780 B2 3/2011 Fitzpatrick et al.
7,958,660 B2 6/2011 Fitzpatrick et al.
8,069,601 B1 12/2011 Fitzpatrick et al.
8,156,677 B2 4/2012 Glock
8,635,796 B2 1/2014 Fitzpatrick et al.
8,839,543 B2 9/2014 Fitzpatrick et al.
8,863,423 B2 * 10/2014 Clifton, Jr. ..... F41A 9/65 42/50
8,991,086 B2 3/2015 Fitzpatrick et al.
D735,831 S 8/2015 Faifer
9,255,749 B2 2/2016 Faifer
9,746,264 B2 8/2017 Fitzpatrick et al.
(Continued)

*Primary Examiner* — Derrick R Morgan

(74) *Attorney, Agent, or Firm* — Ballard Spahr LLP

(57) ABSTRACT

An ammunition magazine is disclosed including a tube surrounding a central space and having first and second ends oppositely disposed and having a first opening being positioned at the first end providing access to the central space. A spacer surrounds the tube proximate to the first end. A catch plate is integrally formed with the spacer. A butt plate is attached to the first end and overlies a portion of the spacer. The spacer being is captured between the butt plate and the tube. A fastener is positioned on the catch plate and engages the butt plate to retain the butt plate to the spacer.

19 Claims, 6 Drawing Sheets

(56) References Cited

U.S. PATENT DOCUMENTS

| | | | | |
|---|---|---|---|---|
| 9,976,825 | B2 | 5/2018 | Faifer | |
| 10,072,903 | B2 | 9/2018 | Fitzpatrick et al. | |
| 10,094,630 | B1 | 10/2018 | Loveday, IV et al. | |
| 10,393,457 | B2 | 8/2019 | Fitzpatrick et al. | |
| 10,480,880 | B2 * | 11/2019 | Thomele | F41A 9/65 |
| 10,801,792 | B2 * | 10/2020 | Pini | F41A 9/65 |
| 10,852,086 | B1 * | 12/2020 | Hillis | F41A 9/71 |
| 10,962,315 | B2 | 3/2021 | Thomele et al. | |
| 11,085,717 | B1 * | 8/2021 | Hillis | F41A 9/71 |
| 11,092,397 | B2 * | 8/2021 | Müller | F41A 9/66 |
| 11,112,193 | B2 * | 9/2021 | O'Clair | F41A 9/65 |
| 11,168,954 | B1 * | 11/2021 | Spykerman | F41A 9/71 |
| 2014/0068992 | A1 * | 3/2014 | Keng | F41A 23/04 42/94 |
| 2015/0121736 | A1 * | 5/2015 | Faifer | F16F 1/04 42/49.01 |
| 2017/0328659 | A1 * | 11/2017 | Fitzpatrick | F41A 9/83 |
| 2018/0051948 | A1 * | 2/2018 | Corso | F41A 9/65 |
| 2020/0208929 | A1 * | 7/2020 | Corso | F41A 9/71 |

* cited by examiner

COMBINATION GRIP SPACER AND CATCH PLATE

CROSS REFERENCE TO RELATED APPLICATIONS

This application is based upon and claims benefit of priority to U.S. Provisional Application No. 63/312,908, filed Feb. 23, 2022, which application is hereby incorporated by reference herein.

FIELD OF THE INVENTION

This disclosure relates a spacer and butt plate assembly for attachment to an ammunition magazine. In more particular, this disclosure relates to an ammunition magazine having a spacer with integrated catch plate.

BACKGROUND

Extended ammunition magazines, i.e., magazines which extend outwardly beyond the end of the grip of a semiautomatic pistol for increased ammunition capacity, advantageously use a spacer attached to the magazine which acts as an extension of the grip to ensure secure and comfortable purchase between the hand and the firearm. There is an opportunity to improve the strength and simplicity of the attachment of the spacer to the magazine.

SUMMARY

This disclosure concerns an ammunition magazine for feeding ammunition to a firearm. In an example embodiment, the magazine comprises a tube surrounding a central space. The tube has a first and a second end oppositely disposed. A first opening is positioned at the first end of the tube providing access to the central space. A spacer surrounds the tube proximate to the first end. A catch plate is integrally formed with the spacer. A butt plate is attached to the first end of the tube and overlies a portion of the spacer. The spacer is captured between the butt plate and the tube. A fastener is positioned on said the catch plate. The fastener engages the butt plate and retains the butt plate to the spacer which in turn secures the spacer to the tube.

In one aspect of the disclosure the tube comprises a pair of lips positioned opposite to one another at the first end thereof. The butt plate may comprise a pair of slots positioned in spaced relation and opposite to one another. The slots receive the lips for attaching the butt plate to said tube.

In another aspect of the disclosure the catch plate comprises a cantilever beam extending from the portion of the spacer. In this aspect the fastener may comprise an aperture positioned in the butt plate and a projection extending from the catch plate toward the butt plate. The projection engages the aperture to retain the butt plate to the spacer.

In an aspect of the disclosure the projection may comprise an action surface oriented at an angle with respect to the catch plate. The projection further has a retaining surface oriented perpendicularly to the catch plate. The retaining surface is arranged on an opposite side of the projection from the action surface. As the butt plate is installed, the cantilever beam deforms until the projection meets the aperture and the cantilever beam then snaps the projection into the aperture to secure the butt plate and spacer to the tube.

In still another aspect of the disclosure the tube may comprise first and second support surfaces arranged in spaced relation opposite to one another on the first end of said tube. The spacer includes first and second lands arranged in spaced relation opposite to one another. The first and second lands respectively engaging the first and second support surfaces when the spacer surrounds the tube.

DETAILED DESCRIPTION

The present disclosure can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

Figure 1:
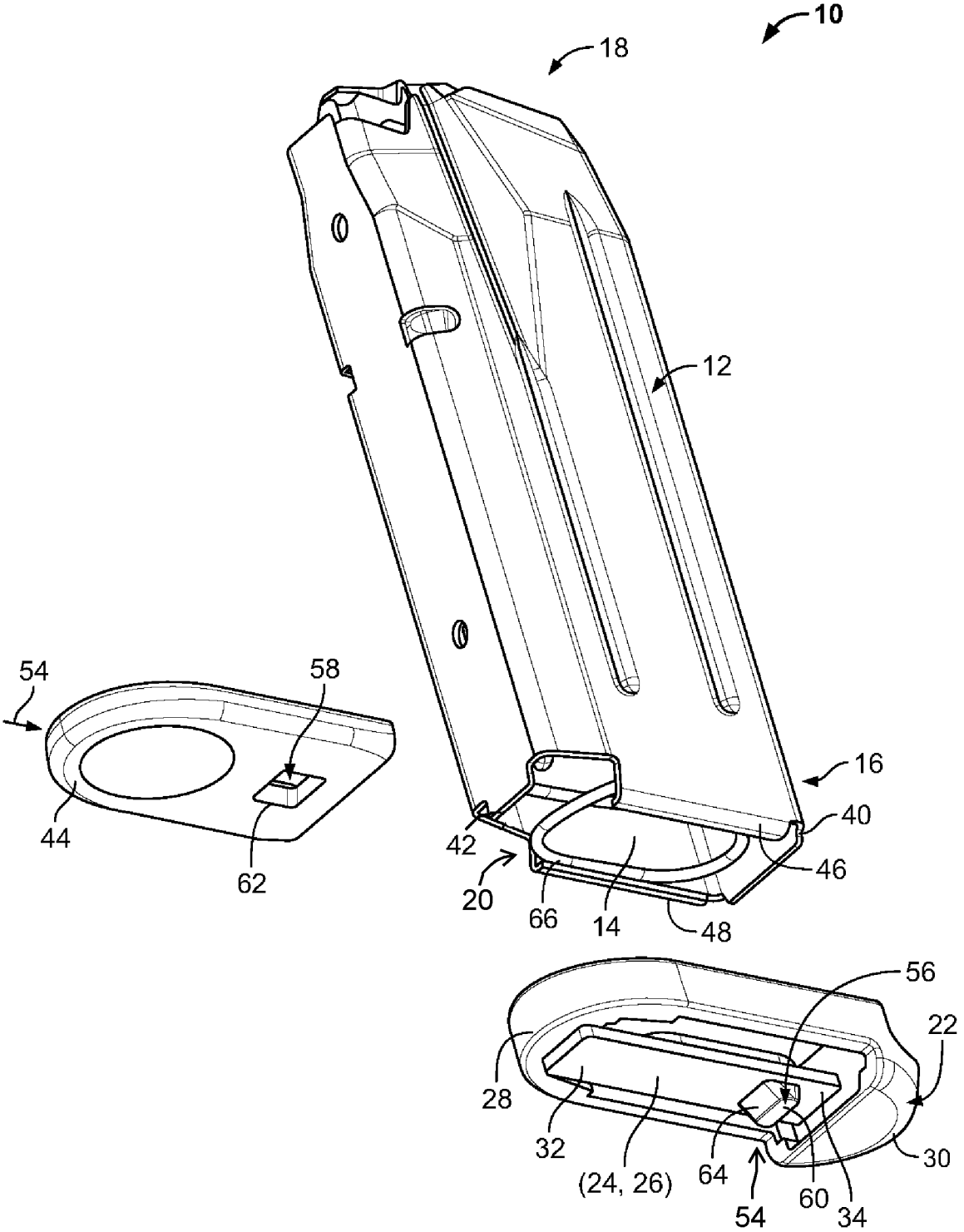
FIG. 1 is an exploded isometric view of an ammunition magazine according to one aspect the disclosure.
Figure 2:
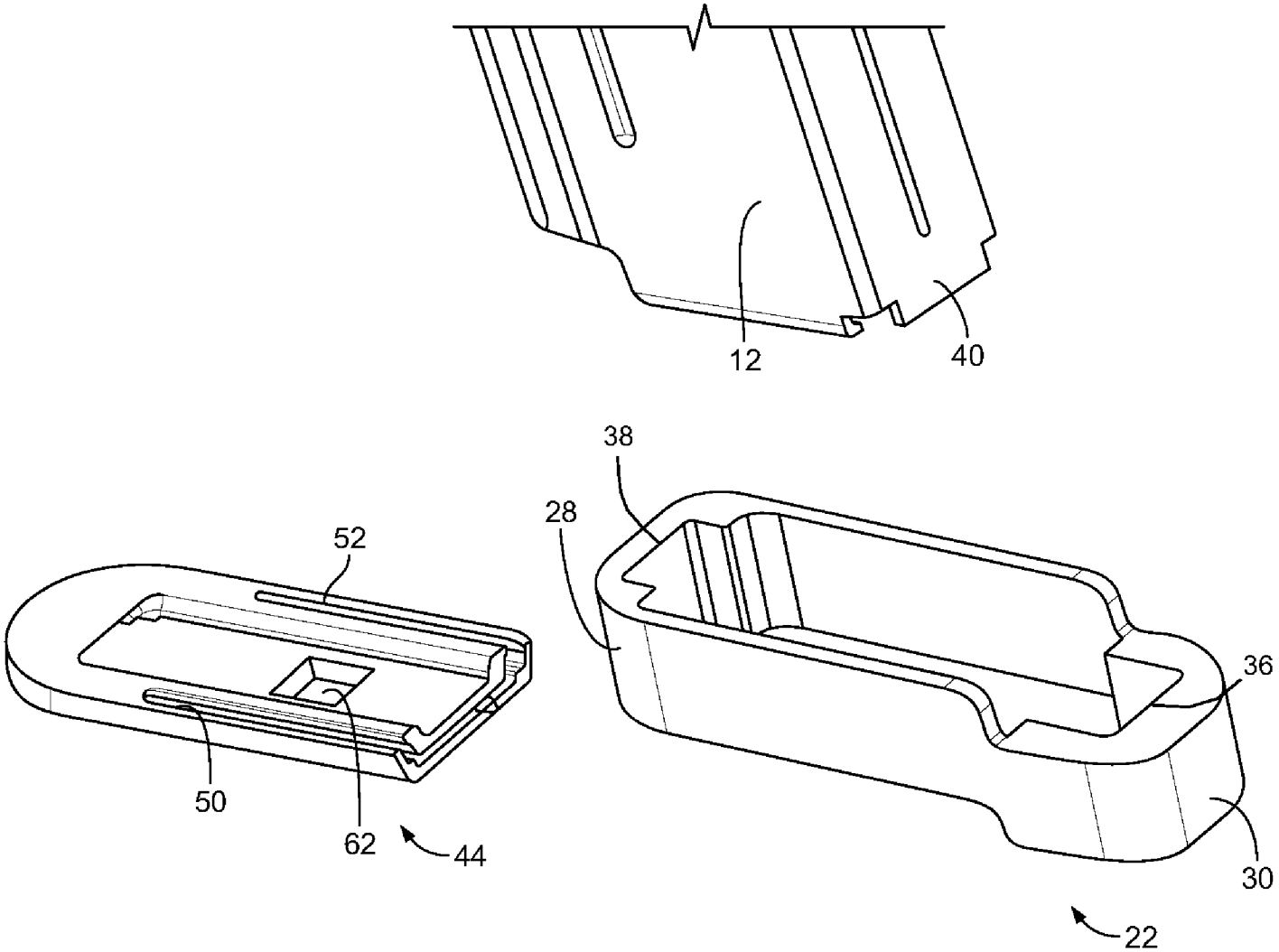
FIG. 2 is a an exploded isometric view of the ammunition magazine shown in FIG. 1, the view taken from a downward angle.

FIG. 1 shows an ammunition magazine 10 according to one aspect of the current disclosure. The ammunition magazine 10 comprises a tube 12 surrounding a central space 14. The tube 12 has first and second ends 16 and 18 oppositely disposed. A first opening 20 is positioned at the first end 16 of the tube 12, the first opening 20 providing access to the central space 14. As shown in FIGS. 1-6, a spacer 22 surrounds the tube 12 proximate to its first end 16. As shown in FIG. 1, a catch plate 24 is integrally formed with the spacer 22. In one aspect the catch plate 24 comprises a cantilever beam 26 extending from the portion of the spacer 22. The spacer 22 is comprised of a first spacer end 28 and a second spacer end 30. In another aspect, the cantilever beam 26 comprises a fixed first end 32 and a free second end 34. In at least one aspect of the disclosure, the fixed first end 32 is connected to the first spacer end 28 and the free second end 34 is proximate the second spacer end 30. In other aspects, the cantilever beam 26 may be affixed in an opposite configuration.

In one aspect the spacer 22 and the tube 12 are engaged through contact between first and second lands 36 and 38, arranged on the spacer 22 in spaced relation opposite to one another (see FIG. 2), and first and second support surfaces 40 and 42 (see FIG. 1) arranged in spaced relation opposite to one another on the first end 16 of the tube 12. Engagement is effected when the spacer 22 surrounds the tube 12.

Figure 3:
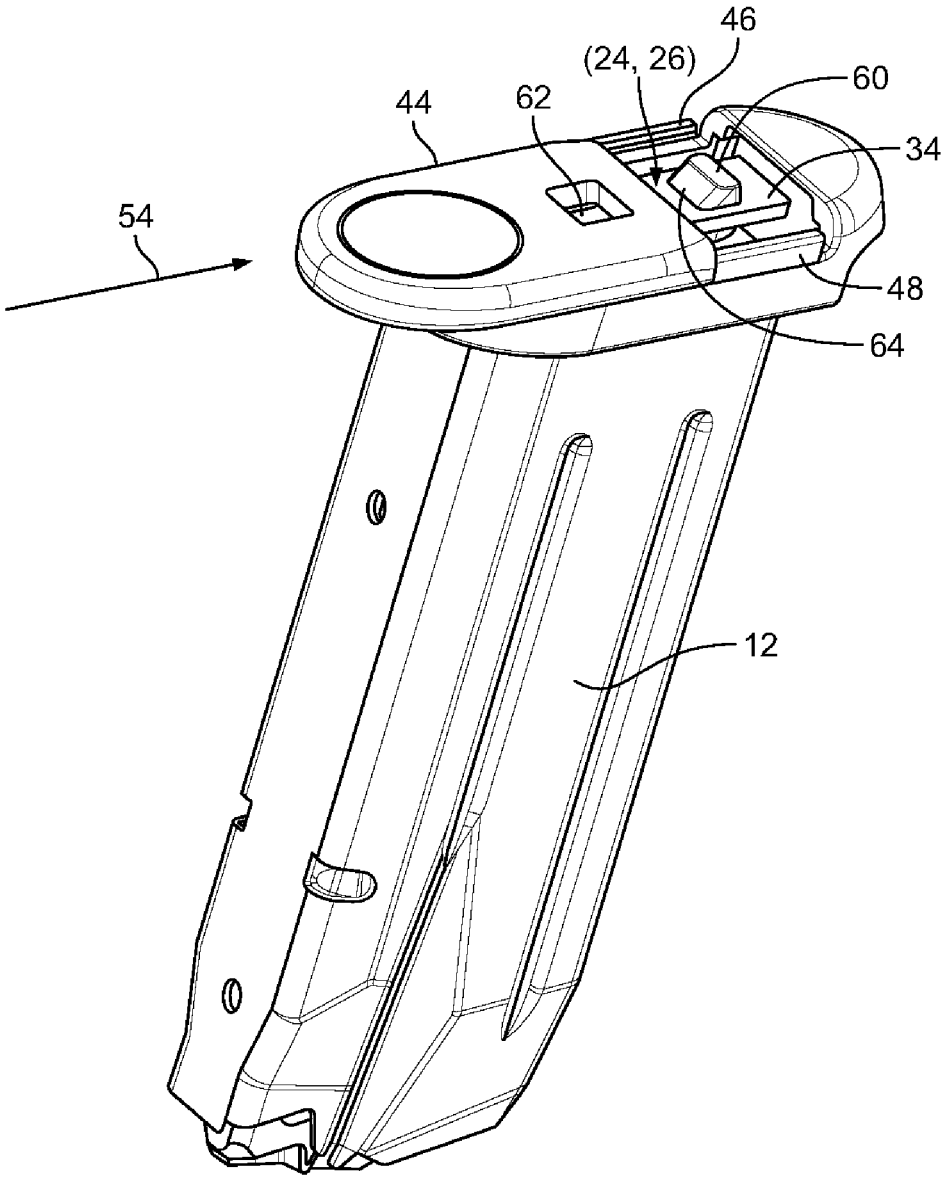
FIG. 3 is an isometric view of the ammunition magazine shown in FIG. 1, the view showing the ammunition magazine partially assembled.
Figure 4:
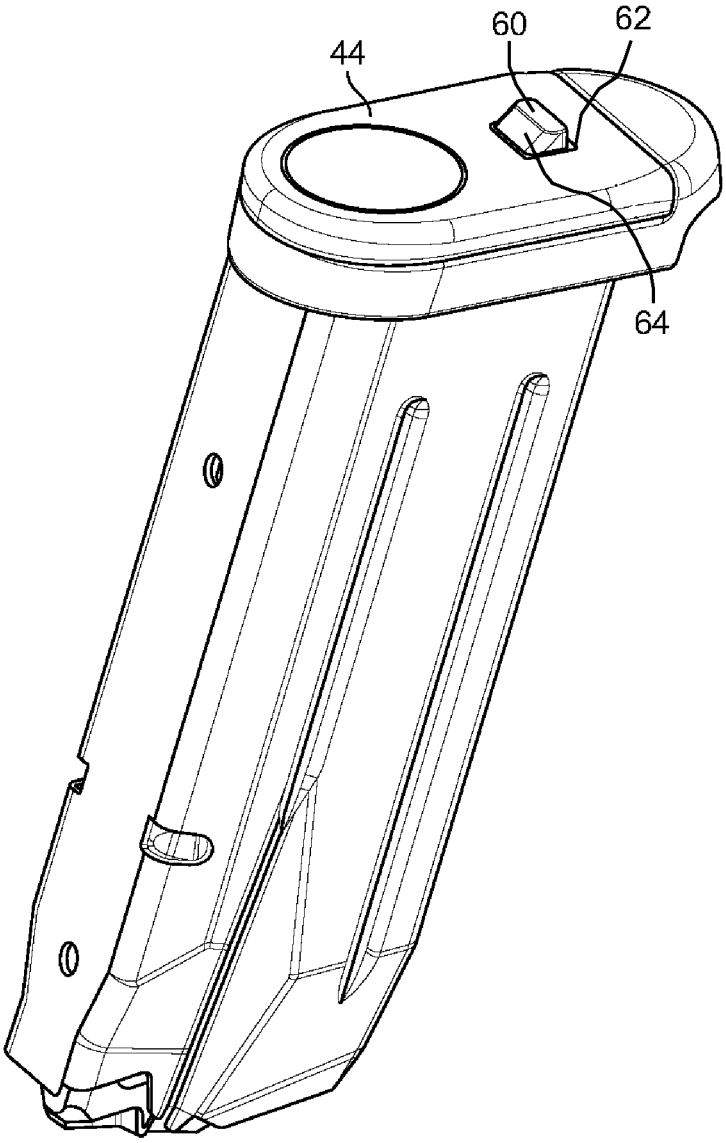
FIG. 4 is an isometric view of the ammunition magazine shown in FIG. 1, the view showing the ammunition magazine assembled.
Figure 6:
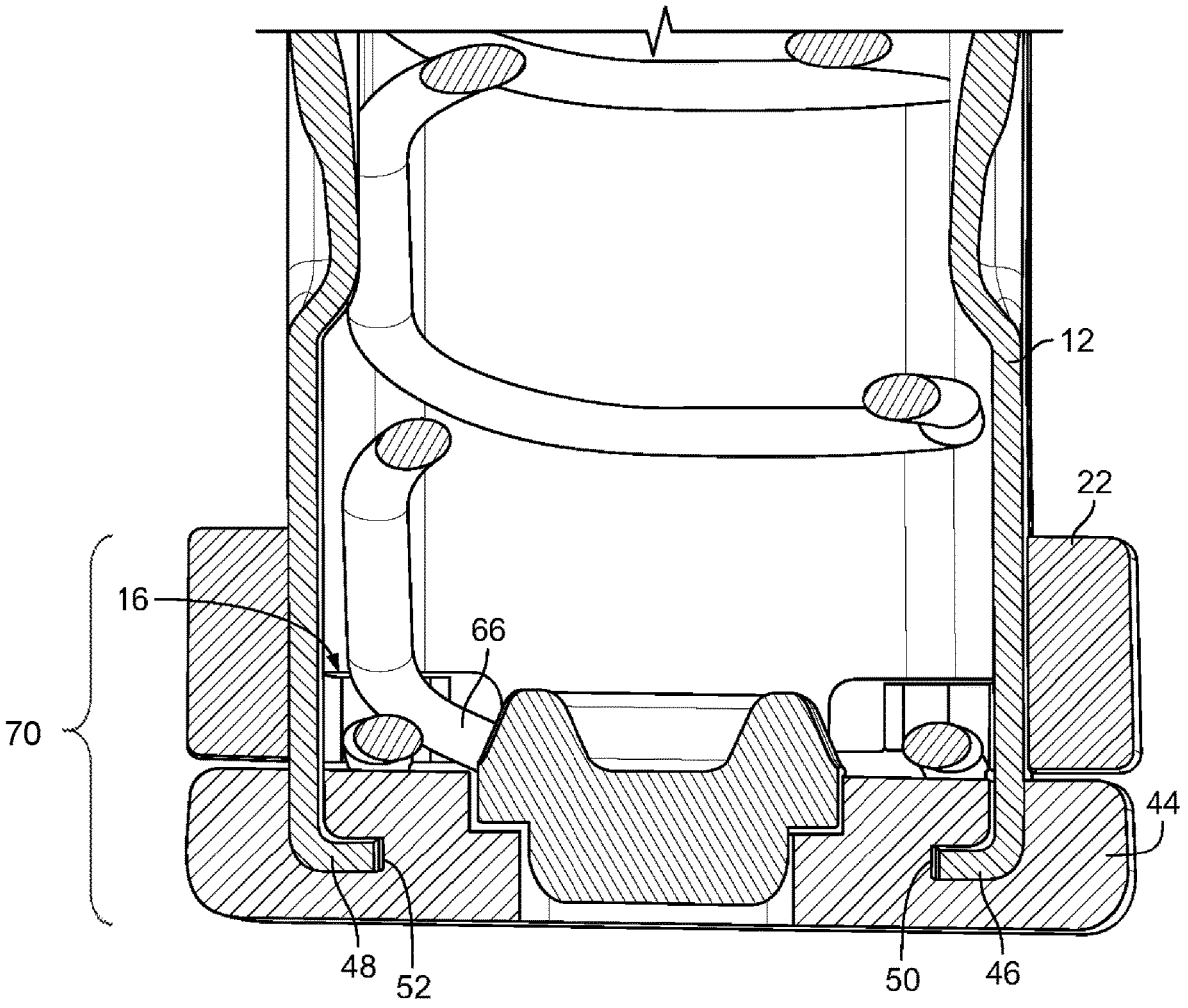
FIG. 6 is a sectional view of a portion of the magazine shown in FIG. 1 and taken in a direction oriented 90° to the sectional view of FIG. 5.

A butt plate 44 is attached to the first end 16 of the tube 12 and overlies a portion of the spacer 22, the spacer 22 thus being captured between the butt plate 44 and the tube 12 (see FIGS. 3 and 4). In this example embodiment, as shown in FIGS. 1, 2, 3 and 6, the tube 12 comprises a pair of lips 46 and 48 positioned opposite to one another at the first end 16 of tube 12. The butt plate 44 comprises a pair of slots 50 and 52 positioned in spaced relation and opposite to one another (see FIGS. 2 and 6). As shown in FIG. 6, the slots 50 and 52 receive respective lips 46 and 48 for attaching the butt plate 44 to the tube 12.

Figure 5:
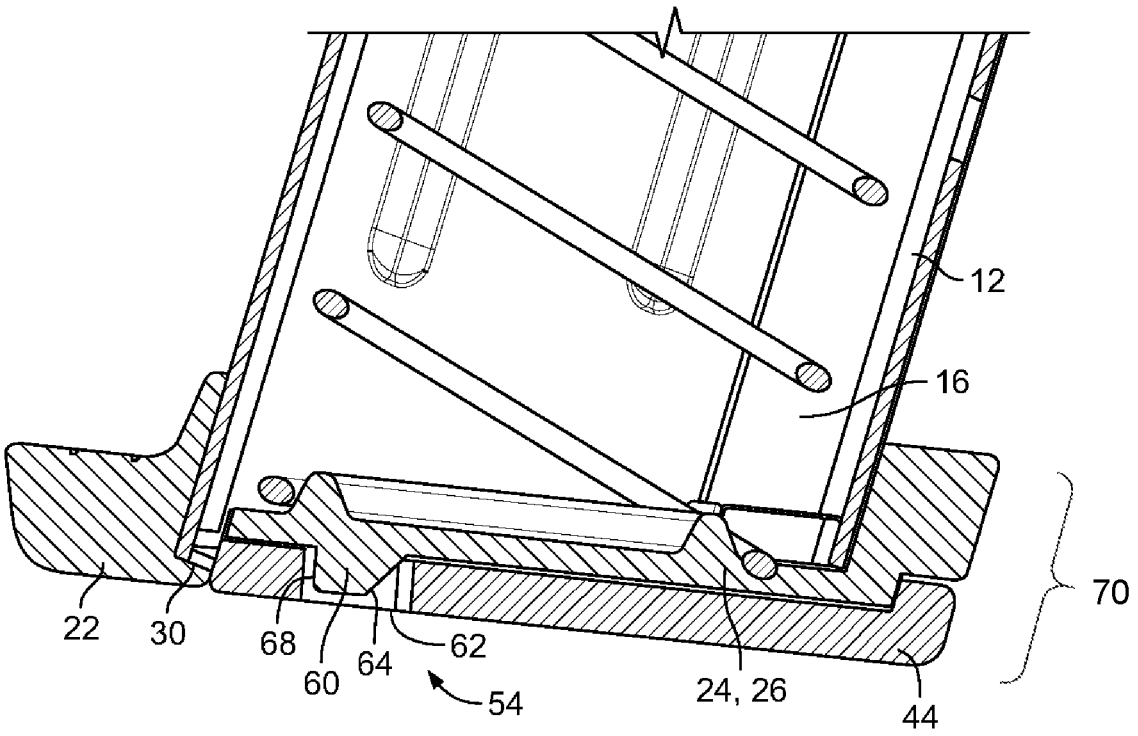
FIG. 5 is a sectional view of a portion of the magazine shown in FIG. 1.

In one aspect, the butt plate 44 is retained to the assembly of spacer 22 and tube 12 via a fastener 54, shown in FIGS. 1 and 5. In one aspect the fastener 54 may comprise at least one catch feature 56 positioned on the cantilever beam 26 and a complementary catch feature 58 positioned on the butt plate 44, shown in FIG. 1. The catch feature 56 engages the complementary catch feature 58 to inhibit sliding motion of the butt plate 44 relative to the tube 12 and thus retain the butt plate 44 to the spacer 22. In one specific aspect, the at least one catch feature 56 comprises a projection 60 extending from the catch plate 24 and the complementary catch feature 58 comprises an aperture 62 positioned in the butt plate 44. The projection 60 extends from the catch plate 24 toward the butt plate 44. The projection 60 engages the aperture 62 to inhibit sliding motion of the butt plate 44 relatively to the tube 12 and thus retain the butt plate 44 to the spacer 22.

Sliding motion of the butt plate 44 relative to the tube 12 permits the spacer 22 and tube 12 to be assembled and disassembled. Assembly of the spacer 22 and tube 12 is made easy by an action surface 64 positioned on the catch plate 24. In one aspect, the action surface 64 is positioned on the cantilever beam 26 in proximate position to the free second end 34. The action surface 64 faces the fixed first end 32 of the cantilever beam 26 and is oriented at an angle with respect to the catch plate 24. As explained with respect to FIGS. 1-4, assembly is effected when the spacer 22 is positioned surrounding the tube 12 proximate to its first end 16. The lands 36 and 38 on the spacer 22 engage respective support surfaces 40 and 42 on the tube 12. The slots 50 and 52 of the butt plate 44 are next engaged with respective lips 46 and 48 of the tube 12, and the butt plate 44 is slid across the first opening 20 of tube 12 in the direction of arrow 54 where it engages the action surface 64 on projection 60 (see FIGS. 1 and 3). Interaction between the butt plate 44 and the angularly oriented action surface 64 causes the cantilever beam 26 to bend, allowing the butt plate 44 to pass over the projection 60. However, when the aperture 62 aligns with the projection 60, a deflecting force is no longer being applied and the cantilever beam 26 returns to its undeformed shape and forces the projection 60 into the aperture 62, thereby acting as a fastener to hold the assembly together, as shown in FIG. 4. In one aspect of the current disclosure, the ammunition magazine 10 further includes at least one spring element 66 in contact with the cantilever beam 26 which acts to further bias the projection 60 into the aperture 62. As shown in FIG. 5, the projection 60 further comprises a retaining surface 68 oriented perpendicularly to the catch plate 26. Retaining surface 68 is arranged on the opposite side of the projection 60 from the action surface 64 and serves to inhibit sliding motion of the butt plate 44 relative to tube 12 and thereby prevents inadvertent disassembly of the magazine 10. Disassembly can be effected by using a tool to depress the projection 60 and deform the cantilever 26 to disengage the projection 60 from the aperture 62, thereby releasing the butt plate 44, which can then slide out of engagement with tube 12 to release the spacer 22.

In at least one additional aspect, the spacer 22 and butt plate 44, as described in their various configurations, together may comprise a spacer and butt plate assembly 70. In this aspect, it is contemplated that the spacer and butt plate assembly 70 may be applied to existing ammunition magazines with appropriate tubes 12 that contain appropriate engagement surfaces for the spacer 22 and butt plate 44.

What is claimed is:

1. An ammunition magazine, said ammunition magazine comprising:

a tube surrounding a central space and having first and second ends oppositely disposed, a first opening being positioned at said first end of said tube providing access to said central space;

a spacer comprising a first spacer end and a second spacer end, said spacer surrounding said tube proximate to said first end of said tube;

a catch plate integrally formed with said spacer, said catch plate defining a cantilever beam comprising a fixed first end and a free second end, said fixed end affixed to said first spacer end;

a butt plate attached to said first end of said tube and overlying a portion of said spacer, said spacer being captured between said butt plate and said tube;

a fastener positioned on said catch plate, said fastener engaging said butt plate and retaining said butt plate to said spacer.

2. The ammunition magazine of claim 1, wherein said tube comprises a pair of lips positioned opposite to one another at said first end thereof, said butt plate comprising a pair of slots positioned in spaced relation and opposite to one another, said slots receiving said lips for attaching said butt plate to said tube.

3. The ammunition magazine of claim 1, wherein said fastener comprises:

an aperture positioned in said butt plate;

a projection extending from said catch plate toward said butt plate, said projection engaging said aperture to retain said butt plate to said spacer.

4. The ammunition magazine of claim 3, wherein said projection comprises an action surface oriented at an angle with respect to said catch plate.

5. The ammunition magazine of claim 4, wherein said projection further comprises a retaining surface oriented perpendicularly to said catch plate, said retaining surface being arranged on an opposite side of said projection from said action surface.

6. The ammunition magazine of claim 1, wherein:

said tube comprises first and second support surfaces arranged in spaced relation opposite to one another on said first end of said tube;

said spacer comprises first and second lands arranged in spaced relation opposite to one another, said first and second lands respectively engaging said first and second support surfaces when said spacer surrounds said tube.

7. An ammunition magazine, said magazine comprising:

a tube surrounding a central space and having first and second ends oppositely disposed, a first opening being positioned at said first end of said tube providing access to said central space;

a spacer comprising a first spacer end and a second spacer end, said spacer surrounding said tube proximate to said first end of said tube;

a catch plate integrally formed with said spacer, said catch plate defining a cantilever beam and at least one catch feature positioned on said cantilever beam, said cantilever beam comprising a fixed first end and a free second end, said fixed end affixed to said first spacer end;

a butt plate attached to said first end of said tube and overlying a portion of said spacer, said spacer being captured between said butt plate and said tube;

wherein said catch feature engages a complementary catch feature on said butt plate and retains said butt plate to said spacer.

8. The ammunition magazine of claim 7, wherein said at least one catch feature is proximate said second spacer end.

9. The ammunition magazine of claim 7, further comprising:

at least one spring element positioned within said central space, said at least one spring element in communication with said cantilever beam and resisting motion of said cantilever beam towards said central space.

10. The ammunition magazine of claim 7, wherein said catch feature comprises a projection extending from said catch plate toward said butt plate and said complementary catch feature comprises an aperture positioned in said butt plate.

11. The ammunition magazine of claim 10, wherein said projection comprises an action surface oriented at an angle with respect to said catch plate.

12. The ammunition magazine of claim 7, wherein said tube comprises a pair of lips positioned opposite to one another at said first end thereof, said butt plate comprising a pair of slots positioned in spaced relation and opposite to one another, said slots receiving said lips for attaching said butt plate to said tube.

13. The ammunition magazine of claim 7, wherein:

said tube comprises first and second support surfaces arranged in spaced relation opposite to one another on said first end of said tube; and said spacer comprises first and second lands arranged in spaced relation opposite to one another, said first and second lands respectively engaging said first and second support surfaces when said spacer surrounds said tube.

14. A spacer and butt plate assembly for use with an ammunition magazine having a tube surrounding a central space, the tube having a pair of lips positioned opposite to one another at a first end, the assembly comprising:

a spacer comprising a first spacer end and a second spacer end, said spacer configured to surround the tube proximate to the first end;

a catch plate integrally formed with said spacer, said catch plate defining a cantilever beam and at least one catch feature positioned on said cantilever beam, said cantilever beam comprising a fixed first end and a free second end, said fixed end affixed to said first spacer end;

a butt plate configured to be received between the pair of lips of the first end of the tube and overlying a portion of said spacer, said spacer being captured between said butt plate and the tube;

wherein said catch feature engages a complementary catch feature on said butt plate and retains said butt plate to said spacer.

15. The spacer and butt plate assembly of claim 14, wherein said at least one catch feature is proximate said second spacer end.

16. The spacer and butt plate assembly of claim 14, wherein said catch feature comprises a projection extending from said catch plate toward said butt plate and said complementary catch feature comprises an aperture positioned in said butt plate.

17. The spacer and butt assembly of claim 16, wherein said cantilever beam is configured to deform away from said butt plate when said butt plate is inserted into the pair of lips and snap back to enter said aperture when said butt plate is fully inserted.

18. The spacer and butt assembly of claim 17, wherein said butt plate cannot be removed from the pair of lips after insertion without depressing the projection.

19. The spacer and butt plate assembly of claim 16, wherein said projection comprises an action surface oriented at an angle with respect to said catch plate.

* * * * *